US009194399B2

(12) United States Patent
Kuwahara et al.

(10) Patent No.: US 9,194,399 B2
(45) Date of Patent: Nov. 24, 2015

(54) PORTABLE BLOWER

(75) Inventors: Yasuaki Kuwahara, Osaka (JP); Tomohisa Itoh, Osaka (JP); Hiroaki Kubo, Osaka (JP); Kensuke Uchimura, Osaka (JP); Akemi Gotoh, Osaka (JP); Ryuhji Asakura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 551 days.

(21) Appl. No.: 13/641,519

(22) PCT Filed: Jul. 20, 2010

(86) PCT No.: PCT/JP2010/062182

§ 371 (c)(1),
(2), (4) Date: Oct. 16, 2012

(87) PCT Pub. No.: WO2011/132329

PCT Pub. Date: Oct. 27, 2011

(65) Prior Publication Data

US 2013/0028711 A1 Jan. 31, 2013

(30) Foreign Application Priority Data

Apr. 19, 2010 (JP) ..... 2010-095753

(51) Int. Cl.
*F04D 25/08* (2006.01)

(52) U.S. Cl.
CPC ..... *F04D 25/084* (2013.01)

(58) Field of Classification Search
CPC ..... F04D 25/08; F04D 25/084
USPC ..... 415/126
See application file for complete search history.

(56) References Cited

U.S. PATENT DOCUMENTS 5,468,124 A * 11/1995 Chen ..... 416/63

(Continued)

FOREIGN PATENT DOCUMENTS

JP 34-18441 Y1 11/1959
JP 53-135006 A 11/1978

(Continued)

OTHER PUBLICATIONS

Official Communication issued in International Patent Application No. PCT/JP2010/062182, mailed on Oct. 19, 2010.

*Primary Examiner* — Ninh H Nguyen
*Assistant Examiner* — Christopher R Legendre
(74) *Attorney, Agent, or Firm* — Keating & Bennett, LLP

(57) ABSTRACT

A portable blower has a casing (2) having an opening portion (24) open in a suction face (2*a*) of the casing (2) facing the installation surface with an inclination and a discharge port (7) open in a top face (2*d*) of the casing (2); an air passage (8) inside the casing (2), connecting between the opening portion (24) and the discharge port (7); and a blower fan (17) inside the air passage (8). As the blower fan (17) is operated, outside air is introduced into the air passage (8) through an intake port (6) formed by part or the whole of the opening portion (24) to pass through the blower fan (17) and then be sent out through the discharge port (7). The opening portion (24) and the discharge port (7) communicate with each other along the inner side of the suction face (2*a*) outside the blower fan (17).

20 Claims, 6 Drawing Sheets

(56) References Cited

U.S. PATENT DOCUMENTS

| | | | | |
|---|---|---|---|---|
| 6,004,367 | A * | 12/1999 | Stopyra et al. | 55/467 |
| 6,109,890 | A * | 8/2000 | Horng | 417/423.14 |
| 6,926,902 | B2 * | 8/2005 | Inoue et al. | 424/409 |
| 7,828,524 | B2 * | 11/2010 | Chen | 416/63 |
| 8,608,437 | B1 * | 12/2013 | Cantin, Jr. | 415/206 |
| 2007/0183940 | A1 * | 8/2007 | Yamamoto et al. | 422/124 |
| 2007/0209701 | A1 * | 9/2007 | Lasko et al. | 137/15.01 |
| 2008/0101928 | A1 * | 5/2008 | Chen | 415/213.1 |
| 2012/0294710 | A1 * | 11/2012 | Lee | 415/203 |
| 2013/0028711 | A1 * | 1/2013 | Kuwahara et al. | 415/121.2 |
| 2013/0034426 | A1 * | 2/2013 | Kuwahara et al. | 415/121.3 |

FOREIGN PATENT DOCUMENTS

| | | | | |
|---|---|---|---|---|
| JP | 2-144690 | U | | 12/1990 |
| JP | 2008-057519 | A | | 3/2008 |
| JP | 3150936 | U | | 6/2009 |
| JP | 3173011 | U | * | 1/2012 |
| JP | 2012007597 | A | * | 1/2012 |
| JP | 2012125276 | A | * | 7/2012 |
| JP | 2014060064 | A | * | 4/2014 |
| WO | WO 2013157140 | A1 | * | 10/2013 |

* cited by examiner

PORTABLE BLOWER

TECHNICAL FIELD

The present invention relates to portable blowers provided with a blower fan in a portable casing.

BACKGROUND ART

A conventional portable blower is disclosed in Patent Document 1 listed below. This portable blower has a portable casing in the shape of a slim box, with an intake port open in the rear face and a discharge port formed in the front face. Inside the casing, an air passage is provided which connects between the intake port and the discharge port, and inside the air passage, a blower fan is arranged which is an axial fan. Moreover, on the side faces of the casing, a swingable stand is provided. When the stand is swung out into contact with the installation surface on a table top, it supports the casing to let it stand on the table top.

With the casing standing on the installation surface on a table top by being supported by the stand, when the blower fan is operated, outside air is introduced through the intake port into the air passage. Here, the rear face of the casing is arranged to face the installation surface with an inclination, and a stream of air is sent out obliquely upward through the discharge port in the front face, toward the user's head etc. This allows the user to readily enjoy the cool outdoors and indoors.

LIST OF CITATIONS

Patent Literature

Patent Document 1: JP-A-2008-57519 (pages 1-3; FIG. 1)

SUMMARY OF INVENTION

Technical Problem

With the conventional portable blower mentioned above, however, when it is set up on a table top, if drink or the like on the table top is spilt, it enters the casing through the intake port in the front face. This poses a risk of electric components inside the casing being flooded, compromising the safety of the portable blower.

An object of the present invention is to provide a portable blower with improved safety.

Solution to Problem

To achieve the above object, according to the present invention, a portable blower includes: a casing which is set up on an installation surface by being supported by a support portion, with an opening portion open in a suction face of the casing facing the installation surface with an inclination, with a discharge port open in the top face of the casing contiguous with the suction face; an air passage which is provided inside the casing and which connects between the opening portion and the discharge port; and a blower fan which is arranged inside the air passage. As the blower fan is operated, outside air is introduced into the air passage through an intake port formed by part or the whole of the opening portion so as to pass through the blower fan and then be sent out through the discharge port. The opening portion and the discharge port communicate with each other along the inner side of the suction face outside the blower fan.

With this configuration, when the casing is set up on the installation surface on a table top, the suction face in which the opening portion is open faces the installation surface with an inclination. As the blower fan is operated, outside air is introduced into the air passage through the intake port formed by part or the whole of the opening portion. The air that passes through the air passage is sent out obliquely upward through the discharge port formed in the top face contiguous with the suction face, toward the user's head etc. Even if drink or the like on the table top is spilt, it is prevented from entering through the intake port because the intake port faces downward. Moreover, if drink or the like enters through the discharge port, it flows down the inner surface of the casing on the inner side of the suction face outside the blower fan, and is drained through the opening portion.

In the portable blower configured as described above, preferably, the opening portion and the discharge port communicate with each other through a gap formed between the blower fan and an inner surface of the casing. With this configuration, if drink or the like enters through the discharge port, it flows down the inner surface of the casing on the inner side of the suction face through the gap, and is drained through the opening portion.

In the portable blower configured as described above, preferably, the opening portion is composed of a plurality of perforations, and there are further provided: a filter which is arranged at the perforations and which collects dust; and an encircling rib which protrudes from the inner side of the suction face and which encircles part of the perforations at which the filter is arranged.

With this configuration, as the blower fan is operated, outside air is introduced into the air passage through the intake port formed by the perforations in the opening portion, and dust contained in the outside air is collected by the filter. Moreover, if drink or the like enters through the discharge port, it flows down the inner surface of the casing on the inner side of the suction face, and is drained through the perforations around the encircling rib. Here, the part of the filter arranged at the perforations inside the encircling rib is prevented from getting wet.

In the portable blower configured as described above, preferably, the opening portion is composed of a plurality of perforations, there is further provided a shielding rib which protrudes from the inner side of the suction face and which is arranged between upper and lower parts of the perforations so as to extend between the left and right ends of the air passage, and the suction side of the blower fan is arranged below the shielding rib.

With this configuration, as the blower fan is operated, outside air is introduced into the air passage through the intake port formed by the perforations located below the shielding rib. If drink or the like enters through the discharge port, it flows down the inner surface of the casing on the inner side of the suction face, and is shielded by the shielding rib so as to be drained through the perforations located above the shielding rib.

In the portable blower configured as described above, preferably, the blower fan is arranged between a control circuit board for operating the blower fan and the opening portion.

In the portable blower configured as described above, preferably, the discharge port is provided lopsided toward the suction face within the top face.

In the portable blower configured as described above, preferably, the casing is formed in the shape of a slim box, the suction face forms a face perpendicular to the thickness direction of the casing, and the opening area of the discharge port is smaller than the opening area of the intake port. With this configuration, in the top face which forms the thickness of the casing in the shape of a slim box, a discharge port having a smaller opening area than the intake port is formed.

In the portable blower configured as described above, preferably, an ion generator which releases ions is provided inside the air passage. With this configuration, as the blower fan is operated, air containing ions is sent out through the discharge port. This allows the user to sterilize or otherwise treat his surroundings.

Advantages of the Invention

According to the present invention, in the suction face facing the installation surface with an inclination, the opening portion forming the intake port is open, and in the top face contiguous with the suction face, the discharge port is open, so that the opening portion and the discharge port communicate with each other along the inner side of the suction face outside the blower fan. Thus, even if drink or the like on the table top is spilt, it is prevented from entering through the intake port facing downward. Moreover, if drink or the like enters through the discharge port, it flows down the inner surface of the casing on the inner side of the suction face outside the blower fan, and is discharged through the opening portion. It is thus possible to prevent the electric components inside the casing from being flooded, and thereby to improve the safety of the portable blower.

DESCRIPTION OF EMBODIMENTS

Figure 1:
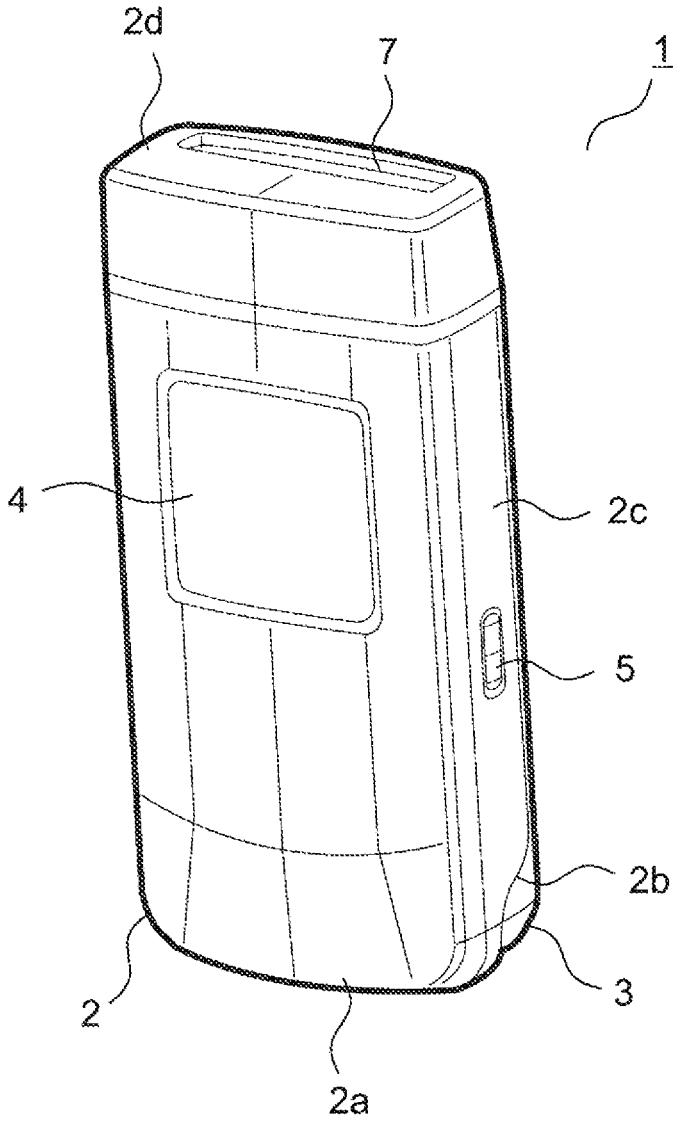
FIG. 1 is a perspective view of a portable blower according to a first embodiment of the invention, as seen from in front.

Hereinafter, embodiments of the present invention will be described with reference to the accompanying drawings. FIG. 1 is a perspective view of a portable blower according to a first embodiment of the invention. The portable blower 1 has a portably sized casing 2 in the shape of a slim box that is rectangular as seen in a front view. On the front face 2*a* of the casing 2 which is perpendicular to its thickness direction, a display portion 4 is provided. The display portion 4 has a liquid crystal display panel or the like, and displays the operating state of the portable blower 1 etc.

The rear face (suction face) 2*b* opposite from the front face 2*a* is perpendicular to the thickness direction of the casing 2, and is covered by a swingable lid portion 3. In the top face 2*d*, which is one of the circumferential faces of the casing 2 that are contiguous with the front and rear faces 2*a* and 2*b*, a discharge port 7 is open, and on one side face 2*c*, which is another of those circumferential faces, a power switch 5 is provided. The discharge port 7 is formed lopsided toward the rear face 2*b*, and is fitted with a lattice-shaped grill 7*a* (see FIG. 2).

Figure 2:
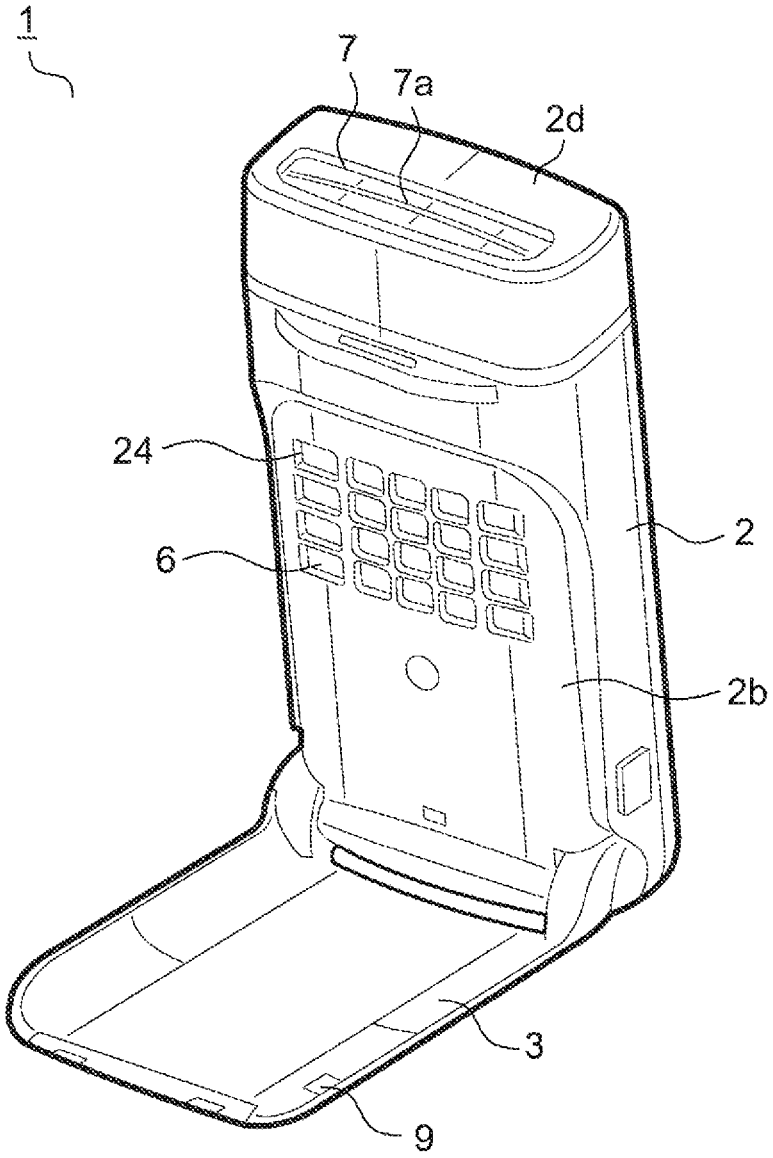
FIG. 2 is a perspective view of the portable blower according to the first embodiment of the invention, as seen from behind.

FIG. 2 is a perspective view of the portable blower 1 as seen from behind, in a state where the lid portion 3 is open. The lid portion 3 is, at a bottom end part thereof away from the discharge port 7, pivoted on the casing 2, and in the rear face 2*b* of the casing 2, an opening portion 24 is open which is composed of a plurality of perforations arranged in a matrix-like array. The entire opening portion 24 faces the suction port (not shown) of a blower fan 17 to form an intake port 6 for taking in outside air.

When the lid portion 3 is open, the intake port 6 is exposed; when the lid portion 3 is closed, the intake port 6 is concealed. When opened, the lid portion 3 supports the casing 2 to let it stand on a table top, and thereby helps set up the portable blower 1 there. Thus, the lid portion 3 constitutes a support portion which supports the casing 2 when the portable blower 1 is set up on an installation surface On the inner surface of the lid portion 3, a magnet 9 is provided. Inside the casing 2, in a position facing the magnet 9 when the lid portion 3 is closed, a magnetism detector (not shown) such as a Hall device or a reed switch is provided. Detecting the magnetism of the magnet 9 with the magnetism detector enables the detection of whether the lid portion 3 is open or closed. Thus, the magnet 9 and the magnetism detector together constitute an open/close detection portion which detects whether the lid portion 3 is open or closed. The open/close detection portion may instead be configured with a push button switch or the like.

Figure 3:
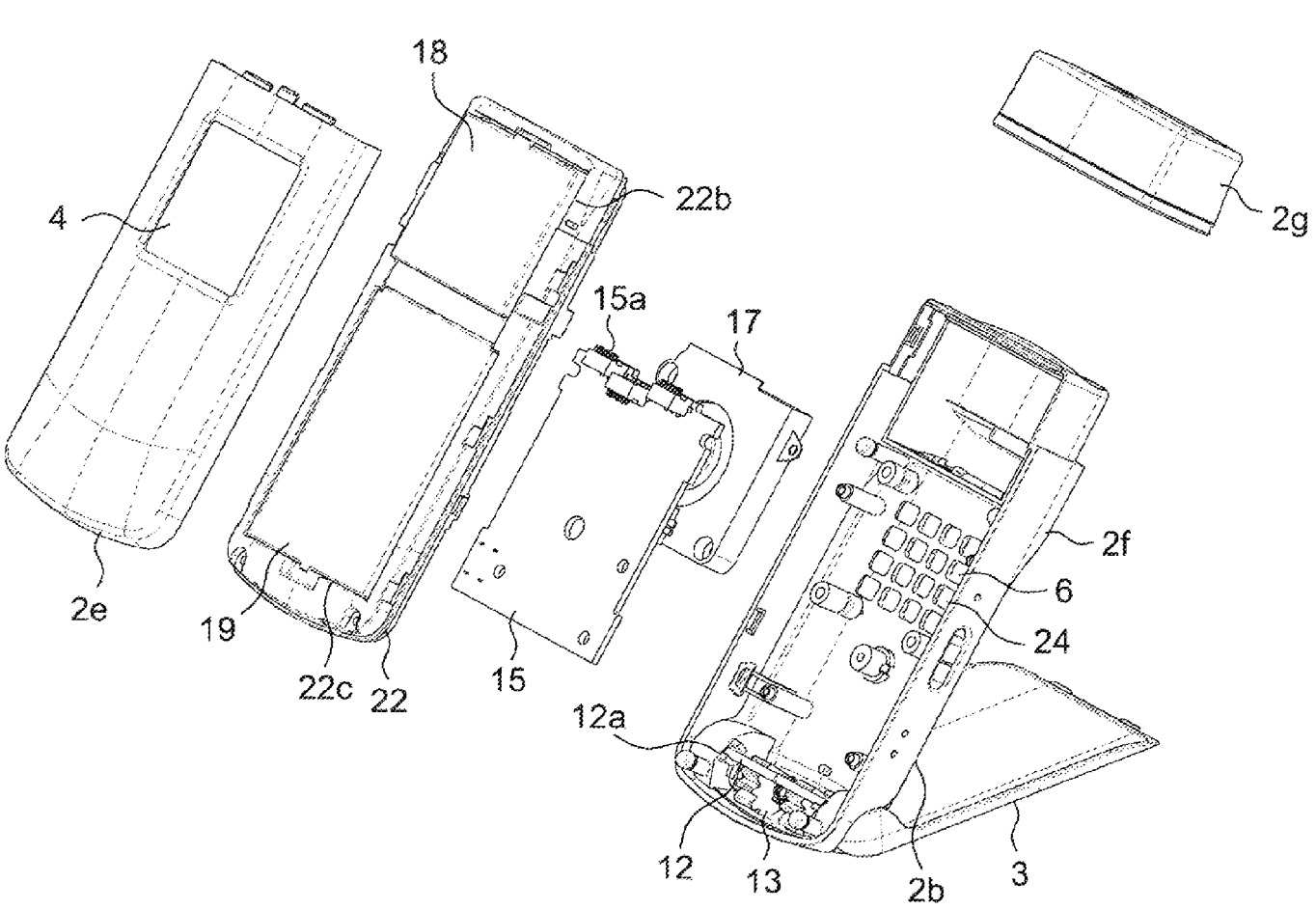
FIG. 3 is an exploded perspective view of the portable blower according to the first embodiment of the invention.

FIG. 3 is an exploded perspective view of the portable blower 1. The casing 2 has a rear panel 2*f* which forms the rear face 2*b*. The rear panel 2*f* is open at the front to have a square bracket-shaped cross section as seen from above.

The open part of the rear panel 2*f* at the front thereof is covered by a partition panel 22. The partition panel 22 is fitted to the rear panel 2*f* with screws (not shown) that thread into screw holes 22*a* (see FIG. 4). On the front of the partition panel 22, a front panel 2*e* is locked, which forms the front face 2*a* of the casing 2 and has a square bracket-shaped cross section as seen from above. On top parts of the front panel 2*e* and the rear panel 2*f*, a cap-shaped top cover 2*g* is fitted. The side faces of the casing 2 are formed by the front panel 2*e* and the rear panel 2*f*, which each have a square bracket-shaped cross section.

The partition panel 22 forms, in a front top part inside the casing 2, an isolated compartment 22*b* and, in a front bottom part inside the casing 2, an isolated compartment 22*c*. On the rear side of the partition panel 22, a control circuit board 15 is fitted on which is mounted a control circuit for the portable blower 1. To the control circuit board 15, terminal portions 15*a* are connected which face onto the isolated compartments 22*b* and 22*c* respectively. In the isolated compartments 22*b* and 22*c*, an ion generator 18 and a battery 19 are respectively accommodated, which are connected via the terminal portions 15*a* to the control circuit. Moreover, between the control circuit board 15 and the intake port 6, a blower fan 17 is provided, which is fastened to the rear panel 2*f* with screws.

Figure 4:
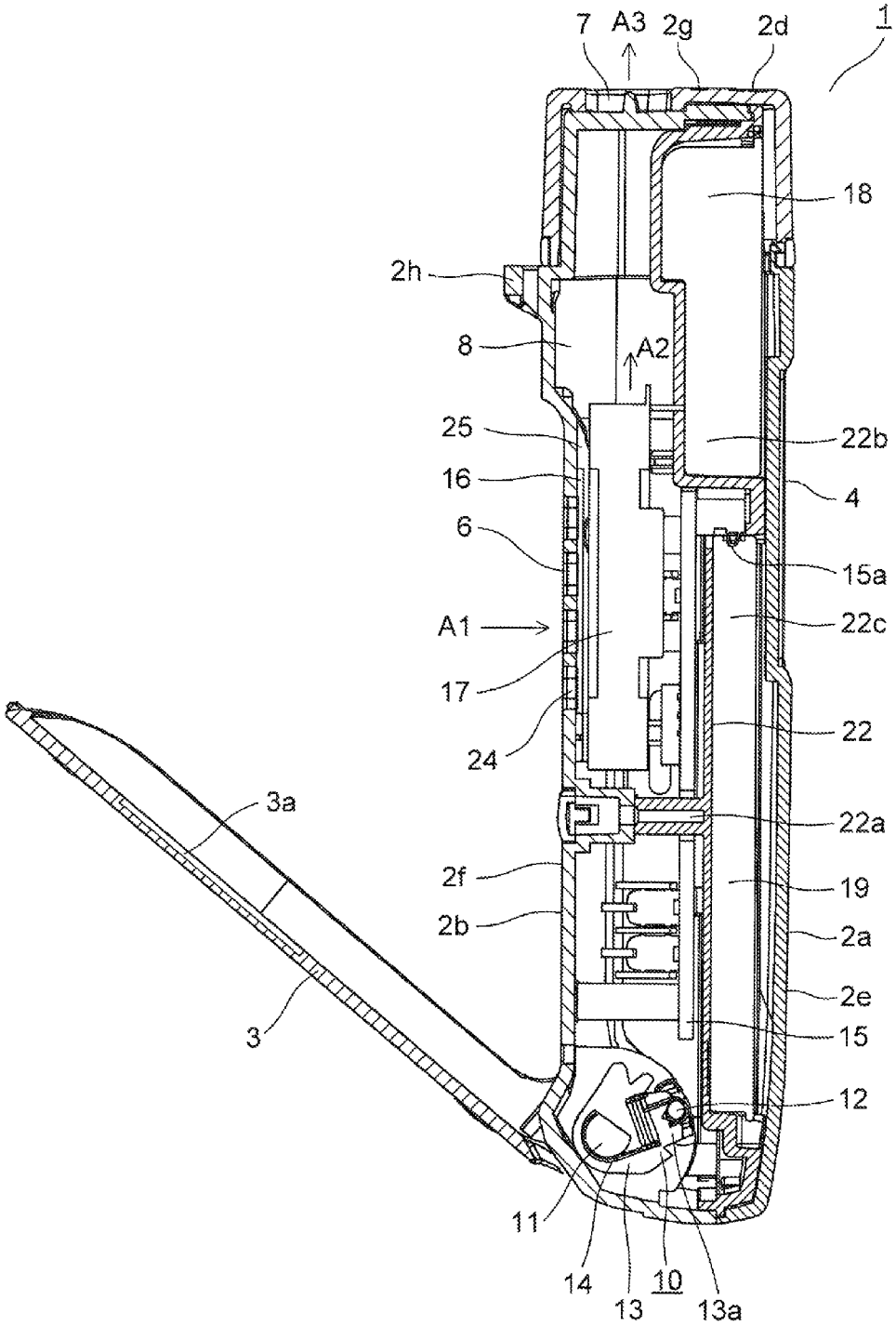
FIG. 4 is a left side sectional view of the portable blower according to the first embodiment of the invention.

FIG. 4 is a left side sectional view of the portable blower 1. Inside the rear panel 2*f*, as a result of its front being covered with the partition panel 22, an air passage 8 is formed which connects between the intake port 6 and the discharge port 7. The blower fan 17 is a centrifugal fan which has an impeller inside a housing, and is arranged inside the air passage 8.

The suction port (not shown) of the blower fan 17, which is open in the axial direction of its housing, is arranged opposite the intake port 6, and the exhaust port (not shown) of the blower fan 17, which is open in a circumferential face of its housing, is arranged in a direction pointing to the discharge port 7. Between the blower fan 17 and the inner surface of the rear panel 2*f*, a gap 25 of a predetermined dimension is provided in the axial direction. Through the gap 25, the opening portion 24, forming intake port 6, and the discharge port 7 communicate with each other outside the blower fan 17. At the intake port 6, a filter 16 is arranged which is fixed on the inner side of the rear panel 2*f* and which collects dust.

In a top part of the rear panel 2*f*, a hole 2*h* is provided to pass a neck strap through. This allows the portable blower 1 to be carried around suspended from the user's neck.

The lid portion 3 is pivoted on the casing 2 via a hinge mechanism 10. The hinge mechanism 10 includes a first shaft 11, a second shaft 12, a gear 13, and a tension spring 14. The first shaft 11 is provided integrally with the lid portion 3, and is rotatably supported on the rear panel 2*f*. The first shaft 11 forms the rotary shaft of the lid portion 3.

The second shaft 12 is supported on a U-shaped support rib 12*a* (see FIG. 3) provided on the rear panel 2*f*, and is arranged to be movable in the radial direction of the first shaft 11. The gear 13 is provided integrally with the first shaft 11, and a plurality of cogs 13*a* are formed on a segment of the gear 13 over a central angle less than 90 degrees. The second shaft 12 is arranged between adjacent cogs 13*a* of the gear 13. The tension spring 14 is, at both ends thereof, suspended from the first and second shafts 11 and 12 respectively, and constitutes a biasing means for biasing the second shaft 12 in a direction in which it is pressed against the gear 13.

As the lid portion 3 swings, the first shaft 11 and the gear 13 rotate together, and the second shaft 12 moves toward the cog ridge (tooth top) of the gear 13 against the biasing force of the tension spring 14. Thus, in relative terms, the second shaft 12 moves in the circumferential direction, from one cog 13*a* to the next. This allows the lid portion 3 to be positioned at desired angles of 90 degrees or less with respect to the casing 2. Thus, when the lid portion 3 is put on an installation surface on a table top, the rear face 2*b* (suction face) of the casing 2 faces the installation surface with an inclination.

When the lid portion 3 is closed, it leaves a gap (not shown) from the rear panel 2*f*. The gap extends between both side end faces of the lid portion 3, so that, in a state where the lid portion 3 is closed, outside air can pass through the gap into the intake port 6. On the inner surface of the lid portion 3, in a position opposite the intake port 6, a recessed portion 3*a* is provided. Owing to the recessed portion 3*a*, the depth of the gap opposite the intake port 6 is greater than the depth of the gap opposite the periphery of the intake port 6.

The recessed portion 3*a* makes the lid portion 3 thinner there, but helps prevent the portable blower 1 from becoming unduly large; besides, the lid portion 3 can be given sufficient rigidity with the thickness of its part opposite the periphery of the intake port 6. The lid portion 3 may be made to protrude rearward at the recessed portion 3*a* to be thicker there so that the lid portion 3 has improved rigidity. In that case, the protruding part of the lid portion 3 is only a part thereof opposite the intake port 6, and this helps prevent the portable blower 1 from becoming unduly large.

The ion generator 18 arranged in the isolated compartment 22*b* has a plurality of electrodes (not shown) facing onto the air passage 8. To the electrodes, a voltage with an alternating-current waveform or an impulse waveform is applied. To one electrode is applied a positive voltage so that the ions resulting from ionization combine with moisture in the air to produce cluster ions with positive charge composed mainly of $H^+(H_2O)m$. To the other electrode is applied a negative voltage so that the ions resulting from ionization combine with moisture in the air to produce cluster ions with negative charge composed mainly of $O_2^-(H_2O)n$. Here, m and n are each an arbitrary natural number.

The ions $H^+(H_2O)m$ and $O_2^-(H_2O)n$ coagulate on the surface of airborne microbes in the air and of odor components and surround them. As given by formula (1) to (3) below, through collision, they coagulate on the surface of airborne microbes and of odor components to generate [.OH] (hydroxyl radical) and $H_2O_2$ (hydrogen peroxide) and thereby destroy them. Here, m' and n' are each an arbitrary natural number.

$$H^+(H_2O)m+O_2^-(H_2O)n \rightarrow .OH+\tfrac{1}{2}O_2+(m+n)H_2O \quad (1)$$

$$H^+(H_2O)m+H^+(H_2O)m'+O_2^-(H_2O)n+O_2^-(H_2O)n' \rightarrow 2.OH+O_2+(m+m'+n+n')H_2O \quad (2)$$

$$H^+(H_2O)m+H^+(H_2O)m'+O_2^-(H_2O)n+O_2^-(H_2O)n' \rightarrow H_2O_2+O_2+(m+m'+n+n')H_2O \quad (3)$$

Configured as described above, the portable blower 1 is carried around in a state where the lid portion 3 is closed. When the lid portion 3 is opened at a desired angle and put on a table top, the lid portion 3 supports the casing 2 to let it stand on the table top. When the power switch 5 is turned on, the blower fan 17 and the ion generator 18 are operated. As the blower fan 17 operates, outside air is introduced through the intake port 6 into the air passage 8 as indicated by arrow A1 (see FIG. 4). Meanwhile, dust contained in the outside air is collected by the filter 16.

The air that has entered the air passage 8 passes through the blower fan 17 and through the air passage 8 as indicated by arrow A2 (see FIG. 4), and contains the ions generated by the ion generator 18. A stream of air containing positive and negative ions is then sent out through the discharge port 7 toward the user's head etc. as indicated by arrow A3 (see FIG. 4). This allows the user to readily enjoy the cool outdoors and indoors, and simultaneously to sterilize and remove odors in the user's surroundings.

When the portable blower 1 is set up on an installation surface on a table top, even if drink or the like on the table top is spilt, it is prevented from entering through the intake port 6 because the intake port 6 faces downward. Moreover, if drink or the like enters through the discharge port 7, it passes through the gap 25 outside the blower fan 17 while flowing down the inner surface of the rear panel 2*f* on the inner side of the rear face 2*b*, and is drained through the opening portion 24 forming the intake port 6. Thus, the intake port 6 constitutes a drain port.

While the portable blower 1 is carried around, when the lid portion 3 is closed, the intake port 6 is covered by the lid portion 3. This prevents the dust attached to the filter 16 from falling out, and thus prevents it from flying into the surroundings or attaching to clothes etc.

While the portable blower 1 is carried around in a state suspended from the user's neck or in a state held in a hand, when the power switch 5 is turned on, outside air is introduced through the gap between the lid portion 3 and the rear panel 2*f* to the intake port 6. Here, owing to the recessed portion 3*a* of the lid portion 3, the air passage has a larger cross sectional area opposite the intake port 6 than opposite the periphery of the intake port 6. This helps reduce the lessening in the amount of passing air.

A stream of air containing ions is then sent out upward through the discharge port 7 arranged in the top face 2*d*. Thus, even while the portable blower 1 is carried around, the user can enjoy the cool, and can also sterilize and remove odors in the user's surroundings.

The power switch 5 has a "sleep" position for bringing the portable blower 1 into a sleep state. When the power switch 5 is at the sleep position, the blower fan 17 and the ion generator 18 operate in response to the opening and closing of the lid portion 3. Specifically, when the open/close detection portion detects the lid portion 3 to be opened, the blower fan 17 and the ion generator 18 are operated; when the open/close detection portion detects the lid portion 3 to be closed, the blower fan 17 and the ion generator 18 stop being operated. Thus, when the user opens the lid portion 3 and sets up the portable blower 1 on a table top, a stream of air containing ions is sent out through the discharge port 7, and this saves the user from operating the power switch 5.

In this embodiment, in the rear face 2*b* (suction face) facing the installation surface with an inclination, the opening portion 24 forming the intake port 6 is open, and in the top face 2*d* contiguous with the suction face 2*b*, the discharge port 7 is open, so that the opening portion 24 and the discharge port 7 communicate with each other along the inner side of the rear face 2*b* outside the blower fan 17. Thus, even if drink or the like on the table top is spilt, it is prevented from entering through the intake port 6 facing downward. Moreover, if drink or the like enters through the discharge port 7, it flows down the inner surface of the casing 2 outside the blower fan 17, and is discharged through the opening portion 24. It is thus possible to prevent the electric components inside the casing 2 from being flooded, and thereby to improve the safety of the portable blower 1.

Moreover, the opening portion 24 and the discharge port 7 communicate with each other through the gap 25 formed between the blower fan 17 and the inner surface of the rear panel 2*f*. Thus, the opening portion 24 and the discharge port 7 can easily be made to communicate with each other outside the blower fan 17.

Moreover, the blower fan 17 is arranged between the circuit board 15 connected to the blower fan 17 and the opening portion 24, and thus the circuit board 15 is arranged in an upper position with respect to the rear face 2*b* forming the suction face. It is thus possible to more reliably prevent the circuit board 15 from being flooded.

Moreover, the discharge port 7 is provided lopsided toward the rear face 2*b* within the top face 2*d* of the casing 2, and this ensures that drink or the like entering through the discharge port 7 flows down the inner surface of the casing 2. It is thus possible to more reliably prevent the electric components inside the casing 2 from being flooded.

Moreover, the casing 2 is formed in the shape of a slim box, the rear face 2*b* in which the opening portion 24 is formed forms a face perpendicular to the thickness direction of the casing 2, and the opening area of the discharge port 7 is smaller than the opening area of the intake port 6. This makes spilt drink or the like less likely to enter through the discharge port 7. It is thus possible to more reliably prevent the electric components inside the casing 2 from being flooded.

Moreover, the ion generator 18 which releases ions is provided inside the air passage 8. This makes it possible to sterilize and remove odors in the user's surrounding.

Figure 5:
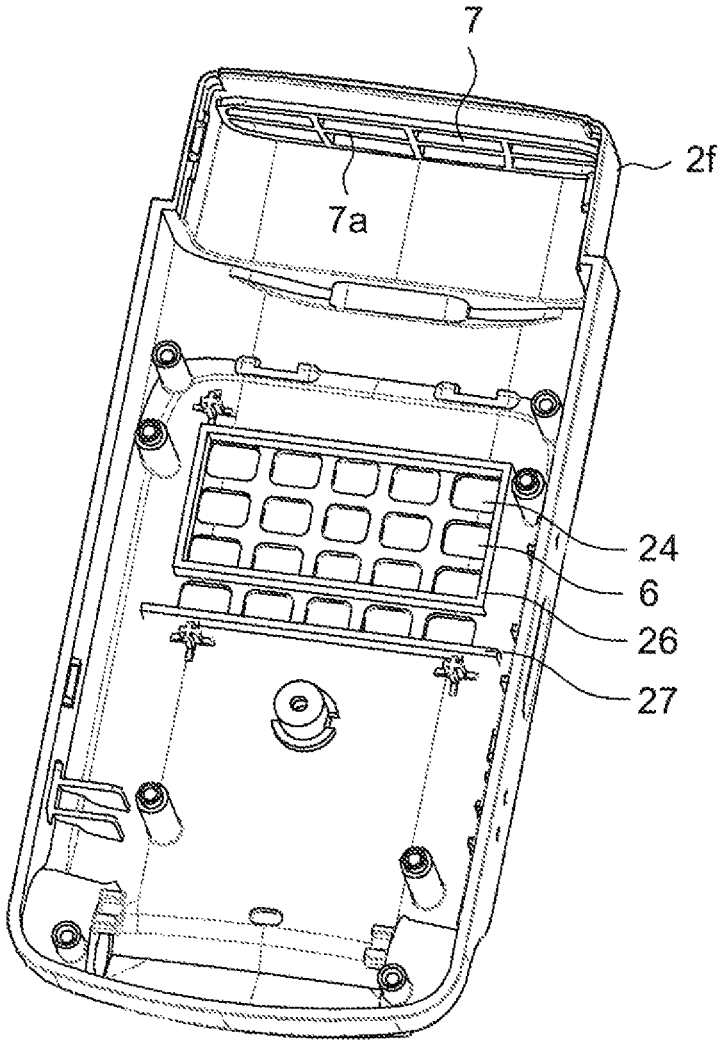
FIG. 5 is a perspective view of the rear panel in a portable blower according to a second embodiment of the invention.

FIG. 5 is a perspective view of the rear panel 2*f* in a portable blower 1 according to a second embodiment of the present invention. For convenience' sake, such parts as find their counterparts in the first embodiment shown in FIGS. 1 to 4 and described previously are identified by the same reference signs. In this embodiment, on the inner surface of the rear panel 2*f*, an encircling rib 26 and a shielding rib 27 are formed. In other respects, the second embodiment is similar to the first embodiment.

The opening portion 24 composed of a plurality of perforations arranged in a matrix-like array as a whole forms the intake port 6, and an upper part of the perforations are encircled by the encircling rib 26. As a result, the perforations in the lowest row are arranged outside the encircling rib 26. The encircling rib 26 crosses the gap 25 (see FIG. 4) between the blower fan 17 (see FIG. 4) and the inner surface of the rear panel 2*f*, and makes contact with the housing of the blower fan 17.

The shielding rib 27 is arranged below the opening portion 24, extends in the horizontal direction, and is arranged to extend between the left and right ends of the air passage 8 (see FIG. 4) formed inside the casing 2. The filter 16 (see FIG. 4) is divided into two parts that face the intake port 6 inside and outside the encircling rib 26 respectively.

In the portable blower 1 configured as described above, if drink or the like on a table top is spilt and enters through the discharge port 7, it flows down the inner surface of the rear panel 2*f* on the inner side of the rear face 2*b*. The drink or the like flowing down the rear panel 2*f* passes around the encircling rib 26 outside the blower fan 17, and is shielded by the shielding rib 27; it is then drained through the perforations in the lowest row forming a drain port.

Thus, the part of the filter 16 inside the encircling rib 26 does not get wet; only the part of the filter 16 provided for the perforations in the lowest row around the encircling rib 26 gets wet. This helps reduce the lessening in the amount of passing air resulting from the filter 16 being flooded and clogging. Moreover, the shielding rib 27 prevents a bottom part of the casing 2 from being flooded. This helps more reliably prevent the flooding of the circuit board 15 (see FIG. 4) which extends downward of the blower fan 17 opposite the opening portion 24.

In this embodiment, as in the first embodiment, if drink or the like enters through the discharge port 7, it flows down the inner surface of the casing 2 outside the blower fan 17, and is drained through the perforations in the lowest row in the opening portion 24. It is thus possible to prevent the electric components inside the casing 2 from being flooded, and thereby improve the safety of the portable blower 1.

Moreover, owing to the encircling rib 26 provided so as to encircle part of the perforations of the opening portion 24, it is possible to reduce the lessening in the amount of passing air resulting from the filter 16 being flooded and clogging. Instead, the perforations in a lower part of the opening portion 24 may be encircled by the encircling rib 26 so that the perforations in an upper part form a drain port.

Figure 6:
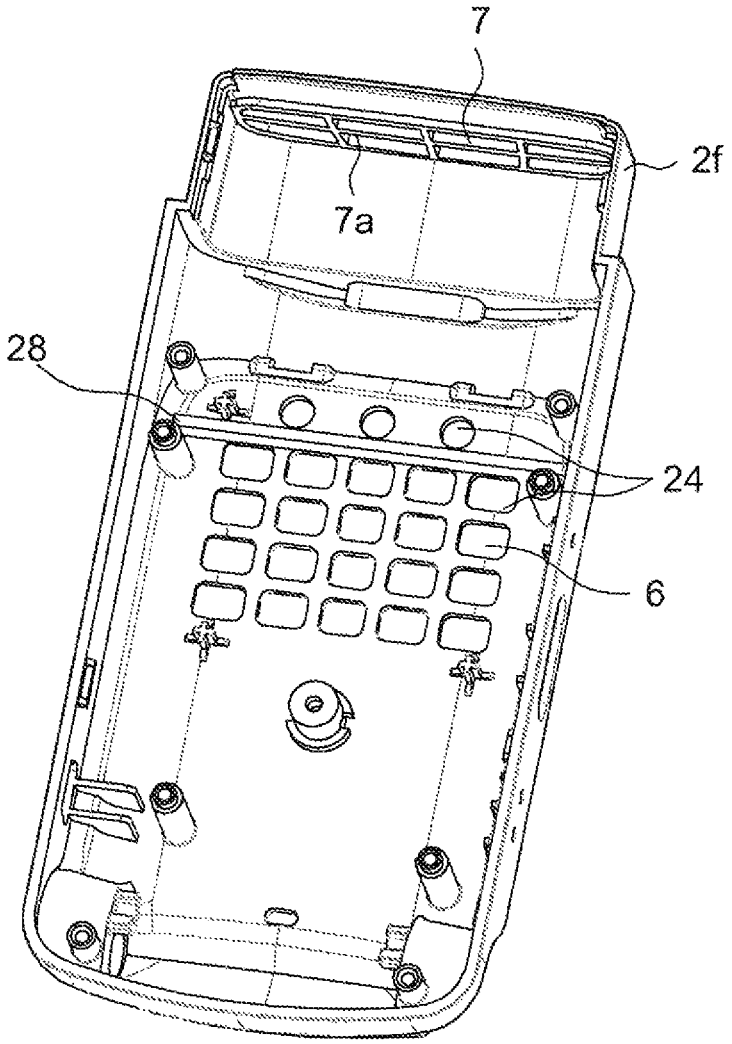
FIG. 6 is a perspective view of the rear panel in a portable blower according to a third embodiment of the invention.

FIG. 6 is a perspective view of the rear panel 2*f* in a portable blower 1 according to a third embodiment of the present invention. For convenience' sake, such parts as find their counterparts in the first embodiment shown in FIGS. 1 to 4 and described previously are identified by the same reference signs. In this embodiment, on the inner surface of the rear panel 2*f*, a shielding rib 28 is formed. In other respects, the third embodiment is similar to the first embodiment.

In the opening portion 24 composed of a plurality of perforations arranged in a matrix-like array, between the perforations in the highest row and those in the second-highest row, a shielding rib 28 is provided. The shielding rib 28 extends in the horizontal direction, and is arranged to extend between the left and right ends of the air passage 8 (see FIG. 4) formed inside the casing 2. The suction port of the blower fan 17 (see FIG. 7) is arranged below the shielding rib 28 so that those perforations of the opening portion 24 which are located below the shielding rib 28 form the intake port 6. Here, the gap 25 (see FIG. 4) between the blower fan 17 and the rear panel 2*f* may be omitted so that the blower fan 17 makes contact with the rear panel 2*f* via the filter 16.

In the portable blower 1 configured as described above, if drink or the like on a table top is spilt and enters through the discharge port 7, it flows down the inner surface of the rear panel 2*f* on the inner side of the rear face 2*b*. The drink or the like flowing down the rear panel 2*f* is shielded by the shielding rib 28 outside the blower fan 17, and is drained through the perforations in the highest row forming a drain port.

In this embodiment, as in the first embodiment, if drink or the like enters through the discharge port 7, it flows down the inner surface of the casing 2 outside the blower fan 17, and is drained through the perforations in the highest row in the opening portion 24. It is thus possible to prevent the electric components inside the casing 2 from being flooded, and thereby improve the safety of the portable blower 1.

Moreover, the suction side of the blower fan 17 is located below the shielding rib 28, and thus the perforations below the shielding rib 28 form the intake port 6. It is thus possible to reduce the lessening in the amount of passing air resulting from the filter 16 provided at the intake port 6 being flooded and clogging.

The shielding rib 28 has only to be provided between the perforations in an upper part and those in a lower part of the opening portion 24. This permits the perforations above the shielding rib 28 to form a drain port and the perforations below the shielding rib 28 to form the intake port 6.

Moreover, the perforations above the shielding rib 28 forming the drain port are located on the exhaust side of the blower fan 17, and thus, when the blower fan 17 is operated, air is likely to leak through the drain port. By making the opening area of the perforations above the shielding rib 28 smaller than the opening area of the discharge port 7, it is possible to reduce leakage of air through the drain port.

In the first to third embodiments, the ion generator 18 may release negative ions alone. This helps the user enjoy their relaxing effect.

INDUSTRIAL APPLICABILITY

The present invention finds applications in portable blowers provided with a blower fan in a portable casing.

LIST OF REFERENCE SIGNS

1 portable blower
2 casing
2*e* front panel
2*f* rear panel
2*g* top cover
3 lid portion
4 display portion
5 power switch
6 intake port
7 discharge port
8 air passage
9 magnet
10 hinge mechanism
11 first shaft
12 second shaft
13 gear
14 tension spring
15 control circuit board
16 filter
17 blower fan
18 ion generator
19 battery
22 partition panel
24 opening portion
25 gap
26 encircling rib
27, 28 shielding rib

The invention claimed is:

1. A portable blower comprising:

a casing including a support portion, an opening portion open in a suction face of the casing, and a discharge port open in a top face of the casing contiguous with the suction face;

an air passage which is provided inside the casing and which connects between the opening portion and the discharge port; and a blower fan including an impeller inside a housing, the blower fan being arranged inside the air passage, wherein the casing is configured such that when the portable blower is stood up in a vertical direction by being supported by the support portion, the opening portion in the suction face of the casing is inclined in a downward direction with respect to a horizontal direction;

as the blower fan is operated, outside air is introduced into the air passage through an intake port defined by at least part of the opening portion so as to pass through the blower fan and then be sent out through the discharge port, the opening portion and the discharge port communicate with each other along an inner side of the suction face inside the air passage but outside the housing of the blower fan, and a gap is defined between the blower fan and an inner surface of the casing.

2. The portable blower according to claim 1, wherein the support portion is a lid which covers the opening portion.

3. The portable blower according to claim 2, wherein the opening portion is composed of a plurality of perforations, and the portable blower further comprises:

a filter which is arranged at the perforations and which collects dust; and an encircling rib which protrudes from the inner side of the suction face and which encircles part of the perforations at which the filter is arranged.

4. The portable blower according to claim 3, wherein the blower fan is arranged between a control circuit board for operating the blower fan and the opening portion.

5. The portable blower according to claim 3, wherein the discharge port is provided off-center on the top face and towards the suction face.

6. The portable blower according to claim 3, wherein the casing is formed in a shape of a slim box, the suction face forms a face perpendicular to a thickness direction of the casing, and an opening area of the discharge port is smaller than an opening area of the intake port.

7. The portable blower according to claim 3, wherein an ion generator which releases ions is provided inside the air passage.

8. The portable blower according to claim 2, wherein the blower fan is arranged between a control circuit board for operating the blower fan and the opening portion.

9. The portable blower according to claim 2, wherein the discharge port is provided off-center on the top face and towards the suction face.

10. The portable blower according to claim 2, wherein the casing is formed in a shape of a slim box, the suction face forms a face perpendicular to a thickness direction of the casing, and an opening area of the discharge port is smaller than an opening area of the intake port.

11. The portable blower according to claim 2, wherein
an ion generator which releases ions is provided inside the air passage.

12. The portable blower according to claim 1, wherein
the opening portion is composed of a plurality of perforations,
the portable blower further comprises a shielding rib which protrudes from the inner side of the suction face and which is arranged between upper and lower parts of the perforations so as to extend between left and right ends of the air passage, and
a suction side of the blower fan is arranged below the shielding rib.

13. The portable blower according to claim 12, wherein
the blower fan is arranged between a control circuit board for operating the blower fan and the opening portion.

14. The portable blower according to claim 12, wherein
the discharge port is provided off-center on the top face and towards the suction face.

15. The portable blower according to claim 12, wherein
the casing is formed in a shape of a slim box,
the suction face forms a face perpendicular to a thickness direction of the casing, and
an opening area of the discharge port is smaller than an opening area of the intake port.

16. The portable blower according to claim 12, wherein
an ion generator which releases ions is provided inside the air passage.

17. The portable blower according to claim 1, wherein
the blower fan is arranged between a control circuit board for operating the blower fan and the opening portion.

18. The portable blower according to claim 1, wherein
the discharge port is provided off-center on the top face and towards the suction face.

19. The portable blower according to claim 1, wherein
the casing is formed in a shape of a slim box,
the suction face forms a face perpendicular to a thickness direction of the casing, and
an opening area of the discharge port is smaller than an opening area of the intake port.

20. The portable blower according to claim 1, wherein
an ion generator which releases ions is provided inside the air passage.

* * * * *